US005708950A

United States Patent [19]

Badesha et al.

[11] Patent Number: 5,708,950

[45] Date of Patent: Jan. 13, 1998

[54] TRANSFUSER

[75] Inventors: Santokh S. Badesha, Pittsford; Werner E. Haas, Webster; Rasin Moser, Fairport; Henry R. Till, East Rochester; Anthony M. Wallace, Penfield; William H. Wayman, Ontario, all of N.Y.

[73] Assignee: Xerox Corporation, Stamford, Conn.

[21] Appl. No.: 569,328

[22] Filed: Dec. 6, 1995

[51] Int. Cl.[6] ..... G03G 15/20

[52] U.S. Cl. ..... 399/333; 399/307

[58] Field of Search ..... 355/271–276, 355/285; 430/124, 126

[56] References Cited

U.S. PATENT DOCUMENTS

| | | | |
|---|---|---|---|
| 3,893,761 | 7/1975 | Buchan et al. . | |
| 3,955,530 | 5/1976 | Knechtel | 118/60 |
| 3,957,367 | 5/1976 | Goel | 355/4 |
| 4,015,027 | 3/1977 | Buchan et al. . | |
| 4,348,098 | 9/1982 | Koizumi | 355/3 TR |
| 4,430,412 | 2/1984 | Miwa et al. | 430/126 X |
| 4,455,079 | 6/1984 | Miwa et al. . | |
| 4,515,460 | 5/1985 | Knechtel | 355/3 TR |
| 4,588,279 | 5/1986 | Fukuchi et al. | 355/3 TR |
| 4,743,939 | 5/1988 | Dulmage et al. . | |
| 4,796,048 | 1/1989 | Bean . | |
| 4,935,788 | 6/1990 | Fantuzzo et al. | 355/326 |
| 5,012,291 | 4/1991 | Buchan et al. | 355/271 |
| 5,089,856 | 2/1992 | Landa et al. | 355/279 |
| 5,103,263 | 4/1992 | Moore et al. | 355/212 |
| 5,141,788 | 8/1992 | Badesha et al. | 428/36.8 |
| 5,200,285 | 4/1993 | Carrish | 355/285 X |
| 5,254,424 | 10/1993 | Felder | 430/112 |
| 5,298,956 | 3/1994 | Mammino | 355/275 |
| 5,337,129 | 8/1994 | Badesha | 355/275 |
| 5,340,679 | 8/1994 | Badesha et al. | 430/126 |
| 5,352,588 | 10/1994 | Fischetti et al. | 435/69.1 |
| 5,355,201 | 10/1994 | Hwang | 355/256 |
| 5,409,557 | 4/1995 | Mammino et al. | 430/126 X |
| 5,418,105 | 5/1995 | Wayman et al. | 430/126 |
| 5,452,063 | 9/1995 | Fletcher | 355/271 |
| 5,456,987 | 10/1995 | Badesha | 428/421 |
| 5,493,369 | 2/1996 | Sypula et al. | 355/256 |
| 5,497,222 | 3/1996 | Landa et al. | 355/279 |
| 5,519,473 | 5/1996 | Morehouse | 355/256 |
| 5,519,476 | 5/1996 | Dalal et al. | 355/279 |
| 5,525,446 | 6/1996 | Sypula et al. | 430/126 X |

*Primary Examiner*—R. L. Moses
*Attorney, Agent, or Firm*—John M. Kelly

[57] ABSTRACT

Printing machines which incorporate a transfusing station having a transfusing member with a resistive heater layer, a substrate, and a release layer. The transfusing station is entrained between at least two electrically conductive contact members, such as rollers, which electrically contact the heater layer. An electrical source sends current through the conductive rollers and the heater layer, heating that layer, the substrate, the release layer, and any toner on the release layer. A backup roller adjacent the transfusing member and the conductive rollers induces pressure on marking substrates which pass between the backup roller and the transfusing member. The combination of heat from the heater layer and pressure induced by the backup roller causes any toner image on the transfusing member to fuse onto the marking substrate. The release layer assists in transferring the toner onto the marking substrate.

18 Claims, 2 Drawing Sheets

TRANSFUSER

FIELD OF THE INVENTION

This invention relates to electrophotographic printing. More specifically, this invention relates to electrophotographic printers which include a transfusing member.

BACKGROUND OF THE INVENTION

Electrophotographic marking is a well known and commonly used method of copying or printing original documents. Electrophotographic marking is typically performed by exposing a light image of an original document onto a substantially uniformly charged photoreceptor. In response to that light image the photoreceptor discharges so as to create an electrostatic latent image of the original document on the photoreceptor's surface. Toner particles are then deposited onto the latent image so as to form a toner powder image. That toner powder image is then transferred from the photoreceptor, either directly or after an intermediate transfer step, onto a marking substrate such as a sheet of paper. The transferred toner powder image is then fused to the marking substrate using heat and/or pressure. The surface of the photoreceptor is then cleaned of residual developing material and recharged in preparation for the creation of another image.

The foregoing generally describes a typical black and white electrophotographic marking machine. Electrophotographic marking can also produce color images by repeating the above process once for each color that makes the color image. For example, the charged photoconductive surface may be exposed to a light image which represents a first color, say cyan. The resultant electrostatic latent image can then be developed with cyan toner particles to produce a cyan image which is subsequently transferred to a marking substrate. The foregoing process can then be repeated for a second color, say magenta, then a third color, say yellow, and finally a fourth color, say black. Beneficially each color toner image is transferred to the marking substrate in superimposed registration so as to produce the desired composite toner powder image on the marking substrate.

The color printing process described above superimposes the various color toner powder images directly onto a marking substrate. Another electrophotographic color printing process uses an intermediate transfer member. In systems which use an intermediate transfer member successive toner images are transferred in superimposed registration from the photoreceptor onto the intermediate transfer member. Only after the composite toner image is formed on the intermediate transfer member is that image transferred and fused onto the marking substrate.

The most common developing materials are dry powder toners. Dry powder developers are typically comprised of not only toner particles but also of carrier granules. The toner particles triboelectrically adhere to the carrier granules until the toner particles are attracted onto the latent image. An alternative to dry powder developing materials are liquid developers. Liquid developers, also referred to as liquid inks, have a liquid carrier into which toner particles are dispersed. When developing with liquid developers both the toner particles and the liquid carrier are advanced into contact with the electrostatic latent image. The liquid carrier is then removed by blotting, evaporation, or by some other means, leaving the toner particles behind.

Intermediate transfer members can also be used in the fusing process. Intermediate transfer members which are used in fusing are referred to herein as transfusing members, and the combined processes of transferring and fusing is called transfusing. Transfusing is highly desirable since the size and cost of transfusing printing machines can be less than comparable printing machines which use a separate transfer station and fusing station. Other advantages such as improved image quality can also be obtained by transfusing. Transfusing members are usually pinched between one or more contact rollers and a backup roller such that a fusing pressure is created between the nip of the backup roller and the transfusing member. During fusing a marking substrate passes between the backup roller and the transfusing member and heat is applied to the toner image. The combination of heat and pressure causes the toner image to fuse onto the marking substrate. Transfusing may be done without heat, but the resulting quality is usually inferior.

One problem with transfusing members is that the transfusing member usually needs to be hot to provide high-quality fusing. That heat can damage the photoreceptor and can interfere with the transfer process. Another problem with transfusing members, particularly when using liquid developers, is that toner tends to stick to the transfusing member during fusing. This results in incomplete transfer of the toner onto the marking substrate and generally poor quality images. Thus, transfusing stations, and printing machines which use such transfusing stations, which reduce the heating of photoreceptors and which have improved toner release characteristics would be beneficial.

Various approaches have been devised to produce multicolor color copies. The following disclosures appear to be relevant:

U.S. Pat. No. 3,955,530
Patentee: Knechtel
Issued: May 11, 1976
U.S. Pat. No. 3,957,367
Patentee: Goel
Issued: May 18, 1976
U.S. Pat. No. 4,348,098
Patentee: Koizumi
Issued: Sep. 7, 1982
U.S. Pat. No. 4,515,460
Patentee: Knechtel
Issued: May 7, 1985
U.S. Pat. No. 4,588,279
Patentee: Fukuchi et al.
Issued: May 13, 1986
U.S. Pat. No. 4,935,788
Patentee: Fantuzzo et al
Issued Jun. 19, 1990
U.S. Pat. No. 5,141,788
Patentee: Badesha et al.
Issued: Aug. 25, 1992
U.S. Pat. No. 5,254,424
Patentee: Felder
Issued: Oct. 19, 1993
U.S. Pat. No. 5,352,558
Patentee: Simms et al
Issued: Oct. 4, 1994
U.S. Pat. No. 5,355,201
Patentee: Hwang
Issued: Oct. 11, 1994
U.S. Pat. No. 5,418,105
Patentee: Wayman et al.
Issued May 23, 1995

The disclosures of the above-identified patents may be briefly summarized as follows:

U.S. Pat. No. 3,955,530 discloses a color image forming electrophotographic printing machine. Different color developers are used to develop the latent images recorded on the photoconductive drum. Each developed image is sequentially transferred to an intermediate transfer drum. A cleaning blade is used to clean the photoconductive drum between developing different color developers. The complete image is transferred from the intermediate drum to a copy sheet.

U.S. Pat. No. 3,957,367 describes a color electrophotographic printing machine in which successive different color toner powder images are transferred from a photoconductive drum to an intermediate roller, in superimposed registration with one another, to an intermediary roller. The multilayered toner powder image is fused on the intermediary roller and transferred to the copy sheet.

U.S. Pat. No. 4,348,098 discloses an electrophotographic copying apparatus which uses a transfix system. In a transfix system, the developed image is transferred from the photoconductive member to an intermediate roller. The intermediate roller defines a nip with a fixing roller through which the copy sheet passes. The developed image is then transferred from the intermediate roller to a copy sheet. The developing unit of the copying apparatus may either be a dry or wet type.

U.S. Pat. No. 4,515,460 describes a color electrophotographic copying machine in which four developer units develop four latent images recorded on a photoconductive drum with different color toner particles. The different color toner powder images are transferred to an endless belt in superimposed registration with one another. The resultant toner powder image is then transferred from the belt to a copy sheet.

U.S. Pat. No. 4,588,279 discloses an intermediate transfer member that has a dry toner image transferred thereto from the surface of a toner image forming member. The toner image is then transferred from the transfer member to a recording paper.

U.S. Pat. No. 4,935,788 discloses a multicolor printing system that uses liquid developer material which is deposited onto an intermediate member. The composite image is then transferred from the intermediate member to a recording substrate.

U.S. Pat. No. 5,141,788 discloses a fuser member comprised of a substrate having a cured fluoroelastomer with a thin surface layer of polyorganosiloxane.

U.S. Pat. No. 5,254,424 discloses a liquid developer material which contains toner particles formed from a urethane modified polyester.

U.S. Pat. No. 5,352,558 discloses a liquid developer system which uses an absorbing belt.

U.S. Pat. No. 5,355,201 discloses an apparatus for developing an electrostatic latent image with a liquid toner.

U.S. Pat. No. 5,418,105 discloses a method and device for simultaneously transferring and fusing toner images onto a substrate. The patent teaches the use of three fuser rollers and a pressure roller, and the applying of electrical current to those elements such that current flows from the two outer fuser rollers to a center fuser roller.

SUMMARY OF THE INVENTION

The present invention provides for electrophotographic printing machines comprised of transfusing stations having resistively heated transfusing members with a release layer. A transfusing member according to the principles of the present invention is comprised of a substrate, a resistive heating layer on one surface of the substrate, and a release layer, beneficially comprised of a compound which includes polyorganosiloxane, on the other side of the substrate.

A transfusing station according to the principles of the present invention is comprised of a transfusing member which is comprised of a substrate, a resistive layer disposed on one surface of the substrate, and a release layer, beneficially comprised of a compound which includes polyorganosiloxane, disposed on another surface of the substrate; an electrical source for sending electrical current through the resistive layer such that the release layer is heated; and a backup roller adjacent the release layer. The backup roller induces pressure on a marking substrate when the marking substrate passes between the backup roller and the release layer.

A printing machine according to the principles of the present invention includes a photoreceptor having a photoconductive surface, a charging station for charging that photoconductive surface to a predetermined potential, at least one exposure station for exposing the photoconductive surface to produce an electrostatic latent image on the photoconductive surface, at least one developing station for depositing developing material on that latent image to produce a toner image on the photoconductive surface, and a transfusing station. The transfusing station receives the toner image on a release layer of a transfusing member which also includes a resistive heating layer on a substrate. In electrical contact with the resistive heating layer are first and second electrical contacts, which, for example, may be electrically conductive contact rollers. Those contacts are in electrical contact with an electrical source which applies electrical current through the first and second contacts and through the resistive heating layer such that the resistive heating layer heats the toner image. Beneficially the transfusing station further includes a backup roller which is adjacent the transfusing member. The backup roller induces pressure on marking substrates which pass between the backup roller and the transfusing member. The combination of heat and pressure causes the toner image to fuse into the marking substrate. The release layer reduces sticking of the toner layer to the transfusing member

BRIEF DESCRIPTION OF THE DRAWINGS

Other aspects of the present invention will become apparent as the following description proceeds and upon reference to the drawings, in which.

DETAILED DESCRIPTION OF THE PREFERRED EMBODIMENTS

Figure 1:
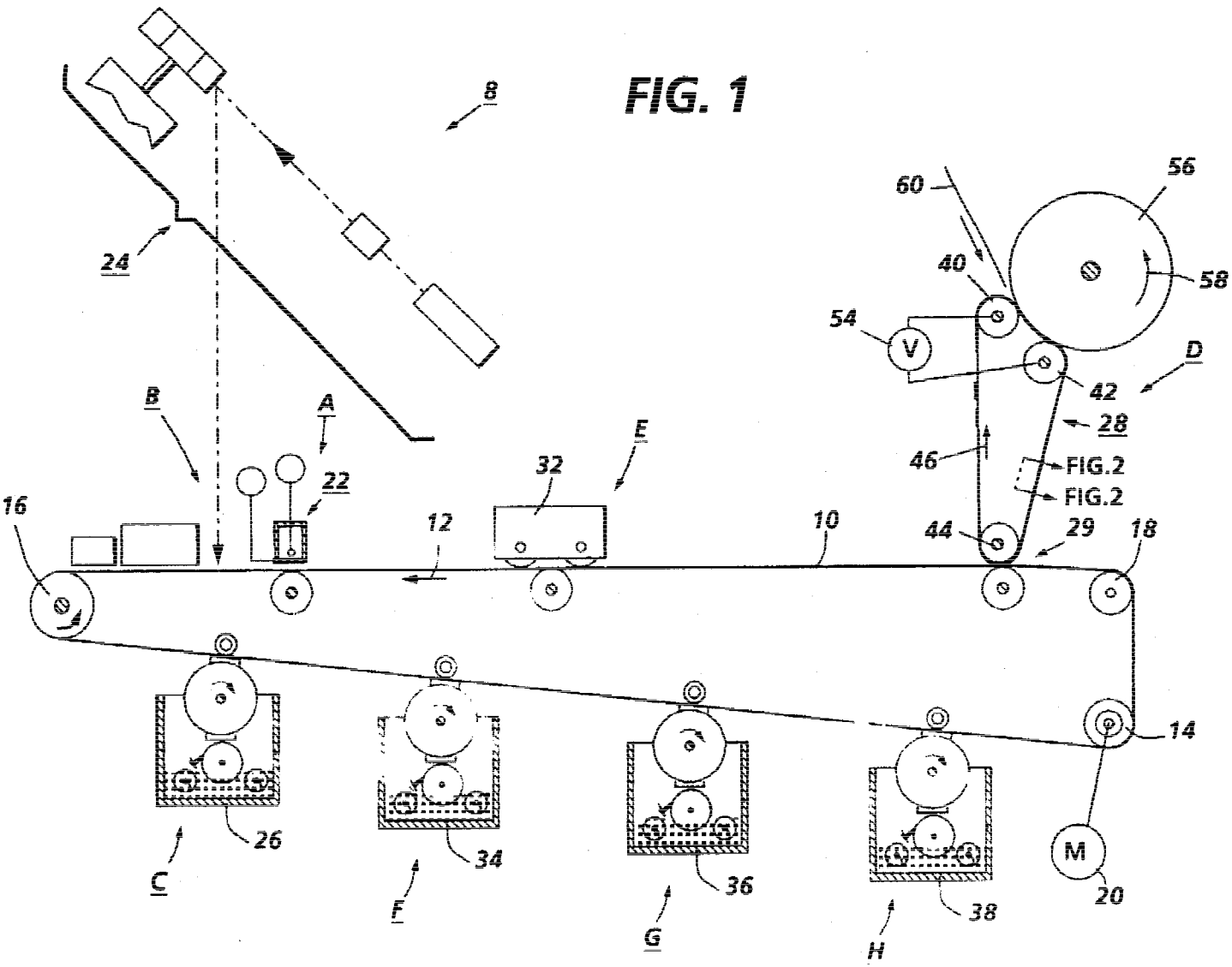
FIG. 1 schematically depicts an electrophotographic printing machine which incorporates the principles of the present invention.

FIG. 1 illustrates an electrophotographic printing machine 8 that copies an original document. Although the principles of the present invention are well suited for use in such electrophotographic copiers, they are also well suited for use in other printing devices, including electrophotographic printers. Therefore it should be understood that the present invention is not limited to the particular embodiment illustrated in FIG. 1 or to the particular application shown therein.

The printing machine 8 includes a charge retentive surface in the form of an Active Matrix (AMAT) photoreceptor 10 which has a photoconductive surface and which travels in the direction indicated by the arrow 12. Photoreceptor travel is brought about by mounting the photoreceptor about a drive roller 14 and two tension rollers, the rollers 16 and 18, and then rotating the drive roller 14 via a drive motor 20.

As the photoreceptor moves each part of it passes through each of the subsequently described process stations. For convenience, a single section of the photoreceptor, referred to as the image area, is identified. The image area is that part of the photoreceptor which is operated on by the various process stations to produce a developed image. While the photoreceptor may have numerous image areas, since each image area is processed in the same way a description of the processing of one image area suffices to explain the operation of the printing machine.

As the photoreceptor 10 moves, the image area passes through a charging station A. At charging station A a corona generating scorotron 22 charges the image area to a relatively high and substantially uniform potential, for example about −500 volts. While the image area is described as being negatively charged, it could be positively charged if the charge levels and polarities of the other relevant sections of the copier are appropriately changed. It is to be understood that power supplies are input to the scorotron 22 as required for the scorotron to perform its intended function.

After passing through the charging station A the now charged image area passes to an exposure station B. At exposure station B the charged image area is exposed to the output of a laser based output scanning device 24 which illuminates the image area with a light representation of a first color image, say black. While FIG. 1 shows the exposure station as using laser light from an output scanning system, other optical projecting and exposure systems, such as an array of light emitting diodes, can also be used. That light representation discharges some parts of the image area so as to create an electrostatic latent image.

After passing through the exposure station B, the now exposed image area passes through a first development station C. The first development station C advances negatively charged development material 26, which is comprised of black toner particles, onto the image area. The development material is attracted to the less negative sections of the image area and repelled by the more negative sections. The result is a first toner image on the image area. While the development material 26, and all of the subsequently described development materials, could be either powder or liquid, the principles of the present invention are particularly useful with liquid development materials. If the development material is a powder toner then the toner image is substantially pure toner particles. However, if the development material is liquid the toner image is comprised of toner particles and a liquid carrier.

After passing through the first development station C the image area advances to a transfusing station D. That transfusing station includes a charged (by a device, devices, or method which, while not shown, can be any of those known in the art) transfusing member 28 which may be a belt, as illustrated in FIG. 1, or a drum. As the image area passes by the transfusing member the first toner image is transferred onto the transfusing member. The transfusing station D is described subsequently.

After the first toner image is transferred to the transfusing member 28 the image area passes to a cleaning station E. The cleaning station E removes any residual development material from the photoreceptor 10 using a cleaning brush contained in a housing 32.

After passing through the cleaning station E the image area repeats the charge-expose-develop-transfer sequence for a second color of developer material (say magenta). Charging station A recharges the image area and exposure station B illuminates the recharged image area with a light representation of a second color image (magenta) to create a second electrostatic latent image. The image area then advances to a second development station F which deposits a second negatively charged development material 34, which is comprised of magenta toner particles, onto the image area so as to create a second toner image. The image area and its second toner image then advances to the transfusing station D where the second toner image is transferred onto the transfusing member 28 in a superimposed registration with the first toner image.

The image area is again cleaned by the cleaning station E. The charge-expose-develop-transfer-clean sequence is then repeated for a third color (say yellow) of development material 36 using development station G, and then for a fourth color 38 (say cyan) of development material using development station H.

The construction and operation of the transfusing station D will now be described in detail. The transfusing member 28 is entrained between a first conductive roller 40, a second conductive roller 42, and a transfer roller 44. The transfer roller is rotated by a motor, which is not shown, such that the transfusing member rotates in the direction 46 in synchronism with the movement of the photoreceptor 10. The synchronism is such that the various toner images are registered with each other after they are transferred onto the transfusing member 28. As previously mentioned the transfusing member is biased to attract charged toner from the photoreceptor.

Figure 2:
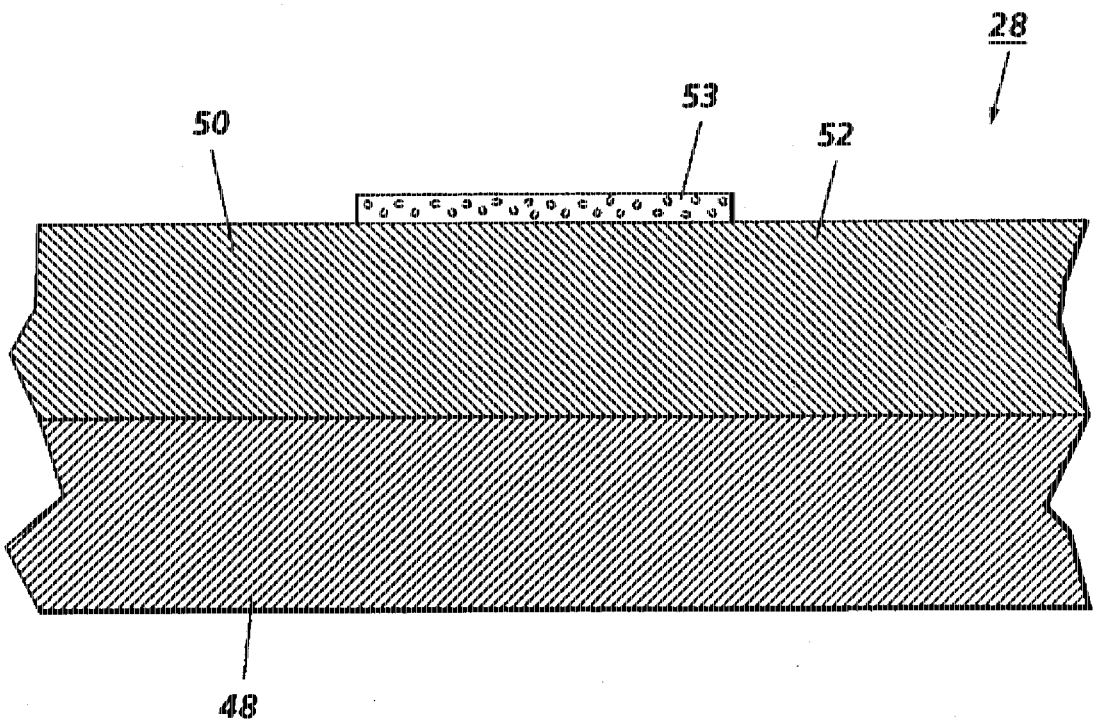
FIG. 2 shows the composition profile of the transfusing member taken along the lines 2---2 of FIG. 1.

The construction of the transfusing member is shown in more detail in FIG. 2, which is a blow up of the section 2—2 in FIG. 1. As shown in FIG. 2, the transfusing member 28 is a seamless assembly of three layers, an electrically resistive heater layer 48, a transfuser substrate 50, and a release layer 52. The toner image layers, represented by the element 53, are deposited on the release layer 52. The resistive layer is an approximately 30 um thick layer of fluorohydropolymers or silicones filled with electrically conducting particulate materials. Suitable electrically conducting particles include carbon black, tin oxide, indium .tin oxide, ionically conducting polymers, and metals like gold silver, copper, and nickel. Suitable fluorohydropolymers include Vitons, available from DuPont, and Fluorel and Aflas, available from the 3M Company. Silicones are readily available from a number of companies, including Dow Corning and General Electric.

The transfuser substrate is an approximately 50 micrometer layer of upilexs. The release layer is an approximately 3 micrometer layer of a hybrid composition of viton and polyorganosiloxane and is called volume graft. A method of making this material is described in U.S. Pat. No. 5,141,788. The heater layer 48 is in electrical contact with the first conductive roller 40 and with the second conductive roller 42. Assemblies related to the transfusing member 28 are taught in U.S. patent application Ser. No. 08/169,802, entitled, "Apparatus and Method for Fusing Toner Images on Transparent Substrates," by Wayman et al., and in U.S. patent application Ser. No. 08/497,567, entitled, "TRANSFUSING ASSEMBLY," by inventor Dalal. Those patent applications are hereby incorporated by reference.

Referring once more to FIG. 1, the transfusing assembly D also includes a source 54 of electrical power. The source supplies electrical current which passes through the first conductive roller 40, the heater layer 48, and the second conductive roller 42. That current causes the heater layer to heat up. That heat passes through the transfuser substrate and though the release layer to the toner image layers 53, causing the image layers to heat. The use of a seamless belt construction is important because a seamed belt would be subject to arcing and wear at each make and break with the contact rollers.

By locating the first and second conductive rollers near each other and far from the transfer roller 44, most of the electrical current from the source 54 will flow through the section of the heater layer 48 which is between the first and second conductive rollers. This arrangement causes much more heat to be generated between the first and second conductive rollers than in other parts of the transfusing member. This is beneficial since the heated section of the transfusing member will have time to cool before another toner image is deposited on the transfusing member. Furthermore, the transfusing member, being in the form of a thin belt, can be made with very low thermal mass. It can thus be heated extremely rapidly to operating temperature and can cool down rapidly as well. This means that the electrical power from the source 54 can be switched on just when an image is to be transfused, leading to reduced overall power consumption because standby power is not required. Moreover, because of rapid cool-down the transfusing member will be relatively cool when it contacts the photoreceptor, minimizing photoreceptor damage.

Alternatively, the transfusing assembly D could be constructed with three fuser rollers which cooperate with a backup (pressure) roller to form an extended fusing zone similar to that taught in U.S. Pat. No. 5,418,105, issued on 23 May 1995 to Wayman et al., which is hereby incorporated by reference. Using three fuser rollers electrical power can be applied such that current flows, and thus heating occurs, only between the three rollers (such as by making the center roller at ground and by applying the same potential to the other two fuser rollers).

Still referring to FIG. 1, the transfusing station D also includes a backup roller 56 which rotates in the direction 58. The backup roller cooperates with the conductive rollers and with the transfusing member to form a fusing zone. When a marking substrate 60 passes through the fusing zone the heated composite toner image contacts the marking substrate as the marking substrate passes between the backup roller and the transfusing member. The combination of heat and pressure fuses the composite toner image onto the marking substrate. The release layer 52 assists in transferring the toner image onto the marking substrate 60.

It is to be understood that while the figures and the above description illustrate the present invention, they are exemplary only. Others who are skilled in the applicable arts will recognize numerous modifications and adaptations of the illustrated embodiments which will remain within the principles of the present invention. For example, while the described embodiment uses electrically conductive rollers which contact the heating layer, other means of making electrical contact with the heating layer, such as by using brushes, may also be used. Therefore, the present invention is to be limited only by the appended claims.

What is claimed:

1. A transfuse member comprised of:

a substrate have a first surface and a second surface:

a resistive layer disposed on said first surface; and a release layer comprised of polyorganosiloxane disposed on said second surface.

2. The transfuse member according to claim 1, wherein said resistive layer is comprised of a fluorohydropolymer.

3. The transfuse member according to claim 1, wherein said resistive layer is comprised of a silicone.

4. The transfuse member according to claim 1, wherein said resistive layer is comprised of an electrically conductive particle.

5. A transfuse station comprised of:

a transfuse member comprised of a substrate have a first surface and a second surface, a resistive layer disposed on said first surface, and a release layer disposed on said second surface;

an electrical source, operatively connected to said resistive layer, for sending electrical current through said resistive layer such that said resistive layer heats said release layer; and a backup roller adjacent said release layer, said backup roller for inducing pressure on a marking substrate when said marking substrate passes between said backup roller and said release layer.

6. The transfuse station according to claim 5, wherein said release layer is comprised of polyorganosiloxane.

7. The transfuse station according to claim 6, wherein said resistive layer is comprised of a fluorohydropolymer.

8. The transfuse station according to claim 6, wherein said resistive layer is comprised of a silicone.

9. The transfuse station according to claim 6, wherein said resistive layer is comprised of an electrically conductive material.

10. A printing machine comprising:

a photoreceptor having a photoconductive surface;

a charging station for charging said photoconductive surface to a predetermined potential;

an exposure station for exposing said photoconductive surface to produce a first electrostatic latent images on said photoconductive surface;

a first developing station for depositing developing material on said first electrostatic latent image so as to produce a first toner image on said photoconductive surface;

a transfusing member for receiving said first toner image from said photoconductive surface, said transfusing member having a release layer for receiving said first toner image, a substrate for supporting said release layer, and a heating layer comprised of a resistive material;

an electrically conductive first contact member contacting said heating layer at a first location;

an electrically conductive second contact member contacting said heating layer at a second location;

an electrical source for sending electrical current through said first contact member, through said heating layer, and through said second contact member such that said heating layer heats said first toner image; and a backup roller adjacent said transfusing member, said backup roller for inducing pressure on a marking substrate when said marking substrate passes between said backup roller and said transfusing member.

11. The printing machine according to claim 10, wherein said release layer is comprised of polyorganosiloxane.

12. The printing machine according to claim 11, wherein said resistive layer is comprised of a fluorohydropolymer.

13. The printing machine according to claim 11, wherein said heater layer is comprised of a silicone.

14. The printing machine transfuse member according to claim 11, wherein said heater layer is comprised of an electrically conductive material.

15. The printing machine according to claim 14, wherein said heater layer is comprised of carbon black.

16. The printing machine according to claim 11, wherein said developing material is a liquid developing material.

17. The printing machine according to claim 11, wherein said developing material is a dry developing material.

18. The printing machine according to claim 11, further including:

an exposure station for exposing said photoconductive surface to produce a second electrostatic latent images on said photoconductive surface; and a second developing station for depositing developing material on said second electrostatic latent image so as to produce a second toner image on said photoconductive surface;

wherein said second toner image is transferred onto said transfusing member in superimposed registration with said first toner image, and wherein both said first and second toner images are fused onto a marking substrate.

* * * * *